United States Patent [19]

Herrmann, Jr.

[11] 4,296,986

[45] Oct. 27, 1981

[54] HIGH VOLTAGE HERMETICALLY SEALED CONNECTOR

[75] Inventor: Henry O. Herrmann, Jr., Mt. Joy, Pa.

[73] Assignee: AMP Incorporated, Harrisburg, Pa.

[21] Appl. No.: 49,770

[22] Filed: Jun. 18, 1979

[51] Int. Cl.[3] ..... H01R 13/62; H01R 14/648

[52] U.S. Cl. ..... 339/89 C; 339/143 C; 339/177 E

[58] Field of Search ..... 339/94 R, 94 C, 177 R, 339/177 E, 143 C, 111, 60R, 61R, 89 C, 143 R

[56] References Cited

U.S. PATENT DOCUMENTS

| | | | |
|---|---|---|---|
| 3,328,744 | 6/1967 | Fiske | 339/61 R |
| 3,402,381 | 9/1968 | Gaw et al. | 339/94 C |
| 3,681,739 | 8/1972 | Kornick | 339/94 C |
| 3,747,048 | 7/1973 | Johnson et al. | 339/75 R |
| 3,824,526 | 7/1974 | Glover | 339/94 R |
| 3,824,553 | 7/1974 | Glover et al. | 339/198 GA |
| 3,871,735 | 3/1975 | Herrmann | 339/177 R |
| 3,963,295 | 6/1976 | Askman et al. | 339/60 R |

*Primary Examiner*—Eugene F. Desmond

*Attorney, Agent, or Firm*—Russell J. Egan

[57] ABSTRACT

A high voltage connector assembly is disclosed for terminating a coaxial cable, and comprises plug and receptacle members. The receptacle member has a profiled blind bore of reduced diameter in a forward face thereof, and peripheral contact means at a forward end having a flared mouth portion diverging outwardly from the forward face. The plug member is provided having a frustoconical forward nose portion, a rearward portion, and an integral intermediate annular flange portion. Conductive material is applied to the plug rearward portion, and to rearwardly and outwardly facing surfaces of the plug flange portion. As the plug nose portion is press inserted into the receptacle bore against a rearward surface within the bore, the plug nose portion flexes outwardly along its taper to evacuate the receptacle bore. Further insertion compresses the plug flange against the receptacle forward face and progressively influences the outwardly facing surface of the plug flange outwardly against the contact means flared mouth portion.

7 Claims, 9 Drawing Figures

HIGH VOLTAGE HERMETICALLY SEALED CONNECTOR

BACKGROUND OF THE INVENTION

1. The Field of Invention

This invention relates to high voltage connectors in general, and in particular to connectors of the type having a tapered plug member for press insertion into a complementarily tapered bore of a receptacle member.

2. Prior Art

In high voltage connectors, especially those designed for the interconnection of time varying potentials, it is critical to provide an air tight seal at the mating interface since the presence of air can destroy the interconnection effectiveness and the interconnection structure itself. However, while stressed air must be eliminated at the interface, unstressed air adjacent the mated rubber plug member is required to provide "breathing space" for the rubber, which expands and contracts in response to temperature variations. The traditional approach to solving the sealing requirement has been to utilize a plug member of tapered forward profile, which is press inserted into a complementarily tapered bore of a receptacle member. Such a configuration is taught by U.S. Pat. No. 3,871,736. Pursuant to this approach, the plug bottoms against a rearward wall within the bore, and progressively flexes outwardly along its taper to thereby evacuate air from the receptacle bore. While this approach has considerable merit, it represents only a partial solution to the industry's problem. For the interconnection of time varying potentials, it is not only desirable to seal the interface between mating connector members within the receptacle bore, but also to continue the seal at the interface to the externally-connected grounding plane. Also, achievement of such a seal can not be at the sacrifice of the above-described unstressed "breathing space" capability.

SUMMARY OF THE INVENTION

The above-mentioned requirements for complete and continuous interfacial sealing capability, and unstressed "breathing space", is achieved by the herein-disclosed mating plug and receptacle members. The plug member, having a forward tapered portion, is provided with a rearward portion and an intermediate annular flange portion. The receptacle member, having a complementarily tapered bore in a forward face, is provided with peripheral contact means at a forward end having a flared mouth portion directed outwardly from said forward face. Conductive material is applied to the plug rearward portion, and to rearwardly and outwardly facing surfaces of the plug flange portion. Subsequent to the press insertion of the plug forward portion into the receptacle bore, application of further force compresses the plug flange against the receptacle forward face, and progressively influences the outwardly facing surface of the plug flange outwardly against the contact means flared mouth portion to create a continuous seal from the forward end of the plug forward portion to the exteriorly connected ground plane. Unstressed air, however, is preserved adjacent the plug flange to enable the connector material to "breathe".

Accordingly, it is an object of the present invention to provide a high voltage connector for positively terminating coaxial cable.

A further object of the present invention is to provide a high voltage connector for terminating coaxial cable and providing a continuous air-tight seal at the connector interface.

Yet another object of the present invention is to provide a high voltage connector for terminating coaxial cable and providing unstressed air adjacent to an air-tight interface to enable the connector material to "breathe" in response to temperature variations.

Still a further object of the present invention is to provide a high voltage connector which is economically and readily produced.

These and other objects of the present invention, which will be apparent to one skilled in the art, are achieved by a preferred embodiment which is described in detail below, and illustrated in the accompanying drawings.

BACKGROUND OF THE DRAWINGS

DETAILED DESCRIPTION OF PREFERRED EMBODIMENT

Figure 1:
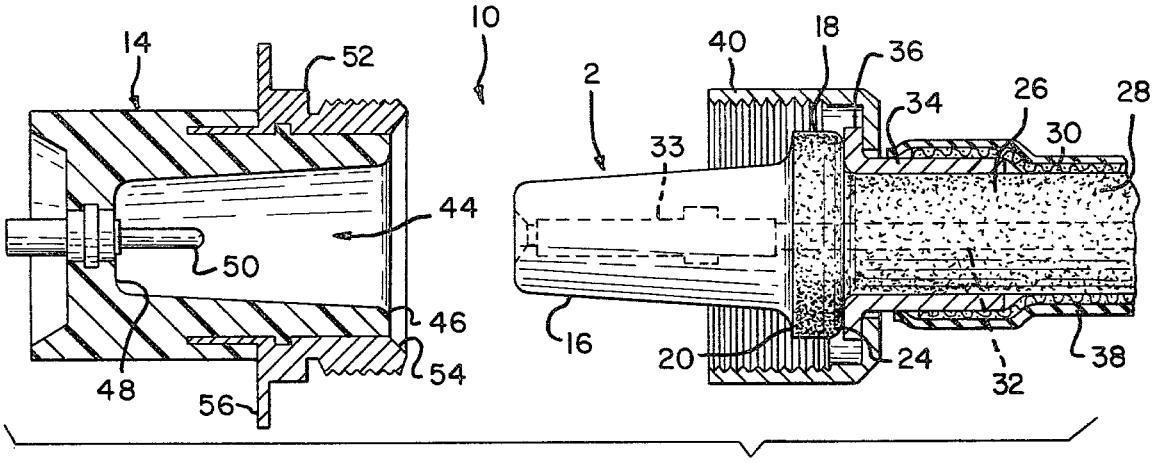
FIG. 1 is an exploded side elevation view in section of the subject plug and receptacle connector members.

Referring first to FIG. 1, the subject connector 10 is shown to generally comprise a plug member 12 and a receptacle member 14. The plug member 12 comprises a forward tapered nose portion 16; an intermediately disposed annular flange 18 having forwardly, outwardly, and rearwardly directed surfaces 20, 22, 24, respectively; and a rearward portion 26. As indicated, the rearward portion 26, and the rearwardly and outwardly directed surfaces 22, 24 of the flange 18 are coated with a conductive covering 28. It should be noted that the plug member 12 is composed of elastomeric silicone rubber or like material.

Continuing, the subject plug terminates a cable lead having an outer shielding layer 30, and an internal conductor 32 having a socket contact 33 affixed to the end thereof which is retained within the plug forward portion 16. The plug rearward portion 26 is intimately bonded to an insulative layer of the cable lead between the shielding layer 30 and the internal conductor 32. A conductive ferrule 34 is provided having a rearward portion positioned between the cable shielding layer 30 and the plug rearward portion 26, and a forward outwardly directed annular flange 36 in abutment against the surface 24 of the plug flange 18. The cable shield 30 can be crimped to the ferrule 34 or, alternatively, soldered. A tube of heat shrinkable material 38, of a type commonly available in the industry, is provided over a forward length of the cable shielding layer 30 and is thermally reduced to protect the termination from environmental effects. As illustrated in FIG. 1, an internally threaded coupling collar 40 is attached to the ferrule 34 through an internally directed annular lip 42 in abutment against the ferrule flange 36.

With continuing reference to FIG. 1, the receptacle member 14 is adapted having a blind bore 44 therein of reduced diameter from a forward face 46 to a rearward interior wall 48 thereof. Further provided the receptacle member 14 is a pin contact 50 secured within the rearward wall 48 and projecting into the bore 44. An externally threaded conductive bushing 52 is secured to a forward end of the receptacle 14, and includes a flared mouth portion 54 diverging outwardly from the forward receptacle face 46, and a rearwardly disposed annular mounting flange 56 intended to retain the receptacle 14 in a bulkhead aperture or the like (not shown). It should be noted that the pin 50 and the plug socket 33 are mateably engageable. It should be further appreciated that the receptacle 14 is made of relatively rigid dielectric material.

Figure 2:
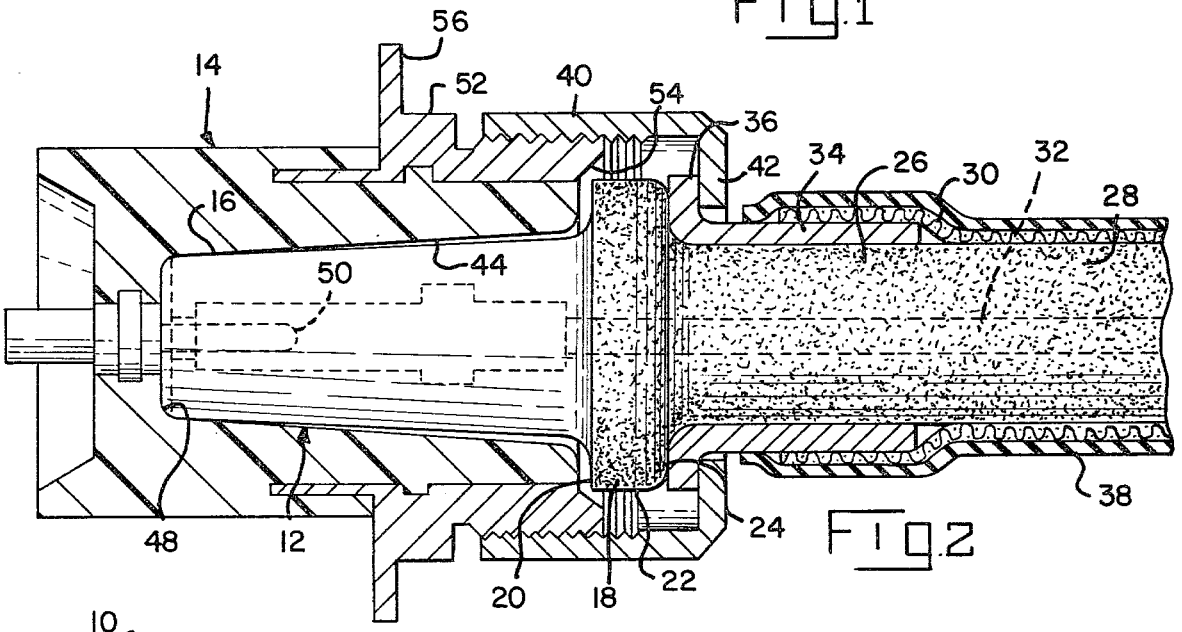
FIG. 2 is a side elevation view in section of the subject connector subsequent to the insertion of the plug member into the receptacle member.

Referring now to FIG. 2, the mating sequence proceeds as follows. As the plug forward portion 16 is inserted into the receptacle bore 44 and bottoms against the rearward wall 48, the pin 50 engages the mating plug socket 33. It will be appreciated that the forward profiled dimension and configuration of the plug member 12 is identical to the profiled dimension and configuration of the rearward wall 48. Also, it should further be appreciated that the angle of taper of the bore 44 is greater than the angle of taper of the plug portion 16. The above-described insertion of the plug is effectuated by engagement between the threaded collar 40 and the threaded bushing 52. As illustrated, the forward surface 20 of the plug flange 18 is displaced forwardly from the forward receptacle face 46 at this initial stage in mating procedure.

Figure 3:
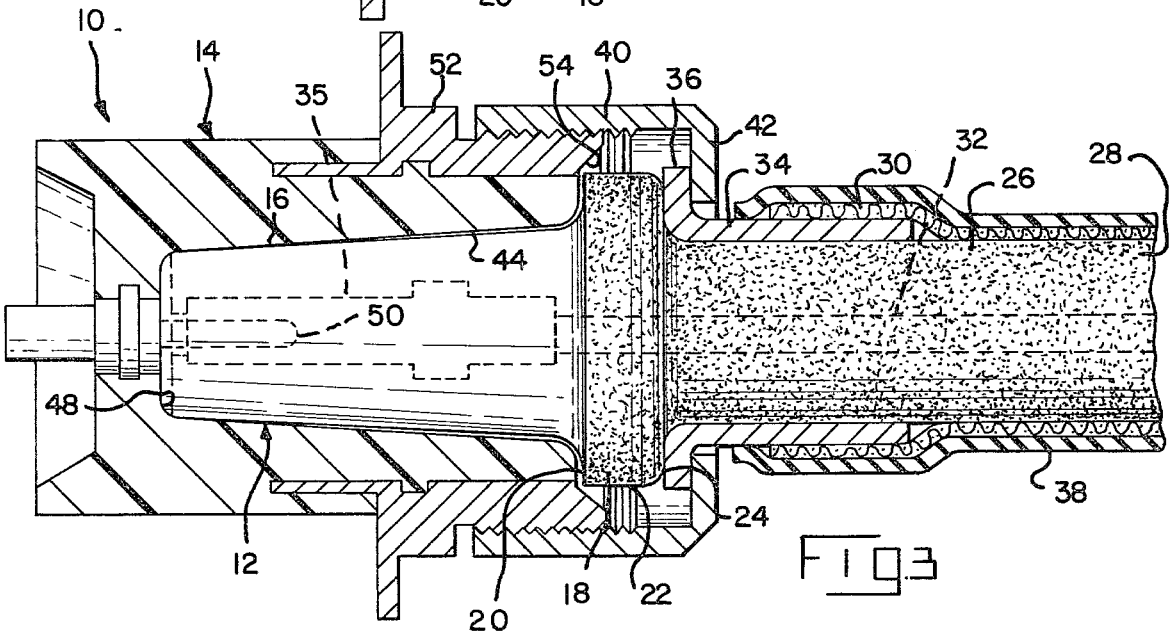
FIG. 3 is a side elevation view in section of the subject connector subsequent to the initial application of compressive force on the plug member.
Figure 4:
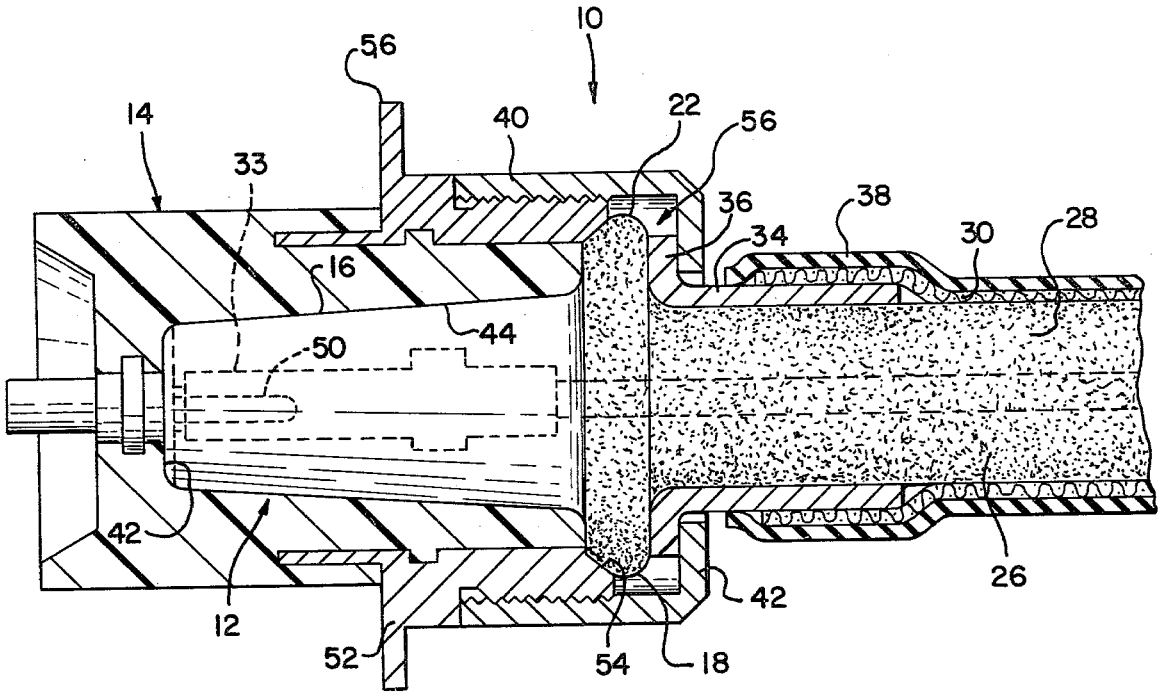
FIG. 4 is a side elevation view in section of the subject connector in a fully mated condition.

As shown by FIG. 3, subsequent tightening of the collar 40 exerts force on the rearward facing surface 24 of the plug flange 18 through the ferrule flange 36. This pressure forces the plug nose portion 16 against the receptacle surface 48 under stress, and causes the nose portion to outwardly flex along its taper progressively toward the receptacle forward face 46, and thereby evacuate air from the receptacle bore 44 in that direction. Further tightening of the collar 40, as illustrated by FIG. 4, initiates contact between the forward surface 20 of the plug flange 18 and the receptacle forward face 46. Still further tightening of the collar 40 compresses the plug flange against the receptacle forward face 46, and causes the outwardly directed surface 22 of the plug flange 18 to progressively contact the flared portion 54 of the conductive bushing 52. Electrical contact is thereby established between the conductive bushing 52 and the cable shielding layer 30 via the conductive coating 28. Throughout the above set forth tightening procedure, it will be appreciated that sealing is achieved sequentially in one direction along the plug member and receptacle member interface. It will further be appreciated that this sealing is continuous along said interface from the forward end of the plug nose portion to the mutually engaged plug flange 18 and bushing flared portion 54. Also, during the unmating of the plug and receptacle members, the interfacial seal will be broken unidirectionally in progressive fashion toward the plug nose portion.

As shown by FIG. 4 at numeral 56, an unstressed air space between the collar 40 and the compressed plug flange 18 exists subsequent to the mating of the plug and receptacle members. This air space 56 enables the silicone-rubber material of the plug member 12 to adaptively "breathe" during variations in the ambient temperature.

It is to be understood that the forms of the invention shown and described herein are but a preferred embodiment thereof and that various changes and modifications can be made therein without departing from the spirit or scope of the invention.

What is claimed is:

1. In a high voltage connector for terminating coaxial cable, of the connector type including an elastomeric plug member having a frustoconical profiled forward portion having first contact means therein connected to a cable center conductor; a receptacle member having a blind bore of complementarily tapered profile in a forward face for receiving the plug forward portion therein and second contact means in said bore mateable with said first contact means; and means for pressuring the plug member against a rearward wall within the receptacle bore, the improvement comprising:

said plug member having a rearward portion connected to a metallic outer shield of the cable, and an integral annular flange portion between said forward and rearward plug portions having frontwardly, rearwardly, and outwardly facing surfaces, and said plug member having conductive coating means over said plug rearward portion and over said flange rearwardly and outwardly facing surfaces;

conductive collar means peripherally secured to a forward end of said receptacle member and having a flared portion diverging outwardly from said forward receptacle face, said plug flange being normally displaced from said receptacle forward face and said flared collar portion upon insertion of said plug forward portion into said receptacle bore; said pressuring means engaging against said plug flange rearward surface and axially pressing said plug member against said receptacle rearward wall, whereby, said forward plug portion flexes outwardly to conform to the interior dimension and profile of said receptacle bore, and, upon continued application of said pressuring means, said plug flange is compressed against said receptacle forward face, and influences said outward plug flange surface progressively into engagement against said flared collar portion.

2. A high voltage connector as set forth in claim 1, wherein said means engaging said shoulder rearwardly facing surface comprising:

a ferrule receiving said plug rearward portion therethrough and having a forward annular flange in abutment against said rearward surface of said plug flange, and a rearward tubular portion positioned between said cable shield and said plug conductive coating means therebeneath; and a threaded collar having an inwardly directed annular lip engaging said ferrule flange, said threaded collar extending forwardly beyond said plug flange portion to circumferentially enshroud said plug flange portion and to define an air space between said collar and said plug flange, said threaded collar being engageable with external threaded means of said receptacle collar means.

3. A high voltage connector as set forth in claim 2 further comprising:

a tube of thermally reduced, heat shrinkable material provided over said tubular portion of said ferrule and a portion of said cable shield therebehind.

4. A high voltage connector as set forth in claim 1, wherein, said second contact means comprising a pin mounted within said rearward wall of said receptacle and said first contact means comprising a socket mateable with said pin.

5. In a high voltage connector plug for terminating coaxial cable, of the plug type having a frustoconical profiled forward portion having first contact means therein connected to a cable center conductor; the plug being intended for mating engagement with a receptacle member having a blind bore of complementarily tapered profile in a forward face for receiving the plug forward portion therein, second contact means in said bore mateable with said plug first contact means, and conductive collar means secured to a forward end of said receptacle member and having a flared portion diverging outwardly from said forward receptable face, the improvement to said connector plug comprising:

a rearward plug portion connected to a metallic outer shield of the cable;

an integral annular flange portion between said forward and rearward plug portions having frontwardly, rearwardly, and outwardly facing surfaces;

conductive coating means over said plug rearward portion and over said flange rearwardly and outwardly facing surfaces;

pressuring means engaging against said plug flange rearward surface for axially pressuring said plug forward portion against a rearward wall within said receptacle bore, whereby, said plug forward portion flexes outwardly to conform to the interior dimension and profile of the receptacle bore, and, upon continued application of said pressuring means, said plug flange is compressed against said receptacle forward face, and influences said outward plug flange surface progressively into engagement against said flared collar portion of the receptacle.

6. A high voltage connector plug as set forth in claim 5, wherein said means engaging said plug flange rearwardly facing surface comprising:

a ferrule receiving said plug rearward portion therethrough and having a forward annular flange in abutment against said rearward surface of said plug flange, and a rearward tubular portion positioned between said cable shield and said plug conductive coating means therebeneath; and a threaded collar having an inwardly directed annular lip engaging said ferrule flange, said threaded collar extending forwardly beyond said plug flange portion to circumferentially enshroud said plug flange portion and to define an air space between said collar and said plug flange, said threaded collar being engageable with external threaded means of said receptacle collar.

7. In a high voltage connector receptacle intended for mating with a plug member, the plug member having a frustoconical profiled forward portion having first contact means therein; an annular flange intermediate portion having an outwardly facing surface provided with conductive coating means thereon; and pressuring means; the receptacle comprising:

a body having a blind bore therein of dimensioned diameter from a forward face for receiving the plug forward portion therein with clearance, said body having a rearward wall within said bore;

second contact means within said rearward wall for matingly engaging said plug first contact means;

conductive collar means peripherally secured to a forward end of said body and having a flared portion diverging outwardly from said forward body face, and having external means for engaging said pressuring means, whereby, upon receipt of the plug forward portion into said receptacle blind bore and application of said pressuring means, said plug forward portion is pressured against said rearward receptacle wall and flexes outwardly to conform to the interior dimension and profile of the receptacle bore, and, upon continued application of said pressuring means, said plug flange is compressed against said receptacle forward face, and influences said outward plug flange surface progressively into engagement against said flared collar portion of said receptacle.

* * * * *